US009457222B2

(12) United States Patent
Dalebout

(10) Patent No.: US 9,457,222 B2
(45) Date of Patent: Oct. 4, 2016

(54) ARCH TRACK FOR ELLIPTICAL EXERCISE MACHINE

(71) Applicant: ICON Health & Fitness, Inc., Logan, UT (US)

(72) Inventor: William T. Dalebout, North Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 84 days.

(21) Appl. No.: 14/068,132

(22) Filed: Oct. 31, 2013

(65) Prior Publication Data

US 2014/0121065 A1 May 1, 2014

Related U.S. Application Data

(60) Provisional application No. 61/720,849, filed on Oct. 31, 2012.

(51) Int. Cl.

| | |
|---|---|
| ***A63B 22/04*** | (2006.01) |
| ***A63B 22/00*** | (2006.01) |
| ***A63B 22/06*** | (2006.01) |
| *A63B 22/20* | (2006.01) |

(52) U.S. Cl.

CPC ..... *A63B 22/001* (2013.01); *A63B 22/0017* (2015.10); *A63B 22/0023* (2013.01); *A63B 22/0664* (2013.01); *A63B 2022/067* (2013.01); *A63B 2022/0676* (2013.01); *A63B 2022/206* (2013.01)

(58) Field of Classification Search

CPC ..... A63B 2022/0017; A63B 22/0007; A63B 22/001; A63B 22/0015; A63B 22/0664

USPC ..... 482/1–148

See application file for complete search history.

(56) References Cited

U.S. PATENT DOCUMENTS

| | | | | |
|---|---|---|---|---|
| 5,993,359 | A | 11/1999 | Eschenbach | |
| 6,422,977 | B1 | 7/2002 | Eschenbach | |
| 6,689,019 | B2 * | 2/2004 | Ohrt | A63B 21/154 482/52 |
| 7,022,049 | B2 * | 4/2006 | Ryan et al. | 482/51 |
| 7,169,088 | B2 * | 1/2007 | Rodgers, Jr. | A63B 22/001 482/52 |
| 7,169,089 | B2 * | 1/2007 | Rodgers, Jr. | A63B 22/001 482/52 |
| 7,172,531 | B2 * | 2/2007 | Rodgers, Jr. | 482/52 |
| 7,179,201 | B2 * | 2/2007 | Rodgers, Jr. | 482/52 |
| 7,201,705 | B2 * | 4/2007 | Rodgers, Jr. | 482/52 |
| 7,214,168 | B2 * | 5/2007 | Rodgers, Jr. | A63B 22/001 482/52 |
| 7,244,217 | B2 * | 7/2007 | Rodgers, Jr. | 482/52 |
| 7,316,632 | B2 * | 1/2008 | Rodgers, Jr. | 482/52 |
| 7,462,134 | B2 * | 12/2008 | Lull et al. | 482/52 |
| 7,468,021 | B2 | 12/2008 | Moon | |
| 7,507,184 | B2 * | 3/2009 | Rodgers, Jr. | 482/52 |

(Continued)

*Primary Examiner* — Stephen Crow

(74) *Attorney, Agent, or Firm* — Holland & Hart LLP

(57) ABSTRACT

An elliptical exercise machine includes a base support structure, first and second reciprocating foot supports movably linked to the base support structure, first and second guide rails, and first and second rollers. The guide rails guide respective first and second foot supports to provide reciprocal movement of the foot supports. The guide rails each include a track surface having first and second end portions and at least first and second arch portions, respectively. The first arch portion is positioned at a location between the first and second end portions and having a first radius of curvature. The second arch portion is positioned at one of the first and second end portions and has a second radius of curvature that is less than the first radius of curvature. The first and second rollers are movable along the track surface of the guide rails.

17 Claims, 5 Drawing Sheets

(56) References Cited

U.S. PATENT DOCUMENTS

| | | | | |
|---|---|---|---|---|
| 7,618,350 | B2 | 11/2009 | Dalebout et al. | |
| 7,641,598 | B2 * | 1/2010 | Rodgers, Jr. | 482/52 |
| 7,658,698 | B2 * | 2/2010 | Pacheco | A63B 21/157 482/52 |
| 7,736,278 | B2 * | 6/2010 | Lull et al. | 482/52 |
| 7,749,137 | B2 * | 7/2010 | Watt et al. | 482/52 |
| 7,758,473 | B2 * | 7/2010 | Lull et al. | 482/52 |
| 8,062,187 | B2 * | 11/2011 | Lull et al. | 482/52 |
| 8,668,627 | B2 * | 3/2014 | Eschenbach | 482/52 |
| 8,814,757 | B2 * | 8/2014 | Eschenbach | 482/52 |
| 8,864,631 | B1 * | 10/2014 | Stearns | A63B 22/0664 482/51 |
| 2007/0054779 | A1 | 3/2007 | Lee | |
| 2007/0087906 | A1 * | 4/2007 | Rodgers, Jr. | 482/52 |
| 2007/0087907 | A1 * | 4/2007 | Rodgers, Jr. | A63B 21/05 482/52 |
| 2010/0041522 | A1 | 2/2010 | Dalebout et al. | |
| 2010/0285928 | A1 * | 11/2010 | Lull et al. | 482/52 |
| 2013/0012363 | A1 * | 1/2013 | Eschenbach | 482/52 |
| 2014/0121065 | A1 * | 5/2014 | Dalebout | A63B 22/001 482/52 |

* cited by examiner

ARCH TRACK FOR ELLIPTICAL EXERCISE MACHINE

CROSS-REFERENCE TO RELATED APPLICATIONS

This application claims priority to U.S. Provisional Patent application 61/720,849 filed on Oct. 31, 2012.

BACKGROUND

Exercise machines having alternating reciprocating foot supports configured to traverse or travel about a closed path to simulate a striding, running, walking, and/or a climbing motion for the individual using the machine are well known, and are commonly referred to as elliptical exercise machines or elliptical cross-trainers. In general, an elliptical or elliptical-type exercise machine comprises a pair of reciprocating foot supports designed to receive and support the feet of a user. Each reciprocating foot support has at least one end supported for rotational motion about a pivot point (e.g., a pivot end), with the other end supported in a manner configured to cause the reciprocating foot support to travel or traverse a closed path, such as a reciprocating elliptical or oblong path or other similar geometric outline (e.g., a closed path end). Therefore, upon operation of the exercise machine, each reciprocating foot support is caused to travel or traverse the closed path, thereby simulating a striding motion of the user for exercise purposes. Typically, the reciprocating foot supports are configured to be out of phase with one another by approximately 180 degrees in order to simulate a proper and natural alternating stride motion.

An individual may utilize an elliptical exercise machine by placing his or her feet onto the reciprocating foot supports. Once standing on the foot supports, the individual may then actuate the exercise machine for any desired length of time and at any desired pace to cause the reciprocating foot supports to repeatedly travel their respective closed paths, which action effectively results in a series of strides achieved by the individual to obtain a desired level of exercise, such as distance travelled or calories burned. Exercise achieved using an elliptical exercise machine is particularly favored by individuals seeking aerobic exercise that causes little or no physical impact.

One type of elliptical exercise machine includes a roller carried at the closed path end of the reciprocating foot support. The roller is supported by a track member. Opposing ends of the track member define a maximum travel distance for the reciprocating foot support. The roller usually does not contact either of the opposing ends of the track member when the user is operating the elliptical exercise machine in a normal stride. However, the roller contacts at least one of the ends of the track member when longer than normal strides are taken. This contact can result in high impact forces that create additional wear and stress in the machine and potential discomfort for the user.

An example elliptical exercise machine that includes a track member is disclosed in U.S. Pat. No. 7,618,350 issued to William T. Dalebout et al. and assigned to Icon IP, Inc. In this patent, an elliptical exercise machine includes a pair of track members within which rollers connected to the reciprocating foot supports move during operation of the machine. The track members define straight tracks that support the rollers. Similar elliptical exercise machines can also be found in U.S. Pat. Nos. 5,993,359; 6,422,977; and 7,468,021 and U.S. Patent Publication Nos. 2010/0041522 and 2007/0054779.

SUMMARY

In one aspect of the disclosure, an elliptical exercise machine includes a base support structure adapted to be positioned on a support surface.

Another aspect of the disclosure may include any combination of the above-mentioned features and may further include first and second reciprocating foot supports, each foot support having an end movably linked to the base support structure.

Another aspect of the disclosure may include any combination of the above-mentioned features and may further include first and second guide rails for guiding respective first and second foot supports to provide reciprocal movement of the foot supports.

Another aspect of the disclosure may include any combinations of the above-mentioned features and may further include a first and second guide rails each including a track surface having first and second end portions in at least first and second arch portions, the first arch portion being positioned at a location between the first and second end portions and having a first radius of curvature, and the second arch portion being positioned at one of the first and second end portions and having a second radius of curvature that is less than the first radius of curvature.

Another aspect of the disclosure may include any combination of the above-mentioned features and may further include first and second rollers movable along the track surface of the first and second guide rails, respectively.

Another aspect of the disclosure may include any combination of the above-mentioned features and may further include track surfaces having a third arch portion positioned at an end portion of the track surface opposite the second arch portion, the third arch portion having a third radius of curvature that is less than the first radius of curvature.

Another aspect of the disclosure may include any combination of the above-mentioned features and may further include the first radius of curvature being greater than 1 meter.

Another aspect of the disclosure may include any combination of the above-mentioned features and may further include the second radius of curvature being in the range of about 1 to about 80 centimeters.

Another aspect of the disclosure may include any combination of the above-mentioned features and may further include the second radius of curvature being the same as the third radius of curvature.

Another aspect of the disclosure may include any combination of the above-mentioned features and may further include the guide rails being fixed relative to the base support structure.

Another aspect of the disclosure may include any combination of the above-mentioned features and may further include the first and second guide rails being fixed relative to the foot supports.

Another aspect of the disclosure may include any combination of the above-mentioned features and may further include a drive assembly situated at a front portion of the elliptical exercise machine, each foot support being linked to the drive assembly such that each foot support is movably linked to the base support structure.

Another aspect of the disclosure may include any combination of the above-mentioned features and may further include the drive assembly being situated at a rear portion of the elliptical exercise machine, each foot support being linked to the drive assembly such that each foot support is movably linked to the base support structure.

Another aspect of the disclosure may include any combination of the above-mentioned features and may further include an upright support structure extending upward from the front portion of the base support structure.

Another aspect of the disclosure may include any combination of the above-mentioned features and may further include the second and third radius of curvature being at least 2 times smaller than the first radius of curvature.

Another aspect of the disclosure may include any combination of the above-mentioned features and may further include the track surface having a decreasing radius of curvature from a midpoint towards opposing ends thereof.

Another aspect of the disclosure may include any combination of the above-mentioned features and may further include the track surface having a continuous arch construction.

Another aspect of the disclosure may include any combination of the above-mentioned features and may further include the first and second rollers providing a low friction interface with the first and second guide rails, respectively, wherein the rollers maintain a fixed position relative to the base support structure and the first and second guide rails move with the foot supports.

Another aspect of the disclosure may include any combination of the above-mentioned features and may further include the first and second guide rails maintaining a fixed position relative to the base support structure and the rollers move with the foot supports.

BRIEF DESCRIPTION OF THE DRAWINGS

The accompanying drawings illustrate various embodiments of the present method and system and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

An elliptical exercise machine including guide rails having at least one arch shaped portion is disclosed herein. Specifically, the present system provides an elliptical exercise machine having a guide rail associated with each of the reciprocating foot supports. The guide rails are configured to increase resistance to movement as the rollers approach opposing ends of the guide rails. This increased resistance helps avoid the rollers hitting a hard stop at opposing ends of the guide rails. Such hard stops typically create jarring forces or shock forces that are uncomfortable for the operator and may cause damage to the elliptical exercise machine.

The guide rails include a track surface that interfaces with the rollers. The track surface may include at least one arch shaped portion. In one example, the entire track surface has an arch shape. The radius of curvature of the track surface may vary along its length. In other examples, only end portions of the track surface are arch shaped and the remaining portions of the track surface (e.g., a mid-section) are linear shaped. In still further examples, at least one of the end portions of the track surface has a linear shape while other portions of the track surface have an arch shape.

The example guide rails discussed below with reference to the figures include a mid-section having a first radius of curvature and opposing end portions having a different radius of curvature than that of the mid-section. The radius of curvature of the opposing end portions (e.g., end-sections) of the track surface may be the same. Typically, the radius of curvature of the end portions of the track surface is less than the radius of curvature of the mid-section. The reduced radius of curvature at the opposing end portions of the track surface may increase the amount of force required to move the roller along the track surface at the opposing end portions. This increased resistance to movement of the roller along the track surface may help slow down the foot support at opposing ends of its reciprocating elliptical motion. In at least some configurations, the change in radius of curvature along the track surface at the opposing end portions makes it unlikely that the roller will hit a hard stop at any point during its movement along the track surface of the guide rail.

Figure 1:
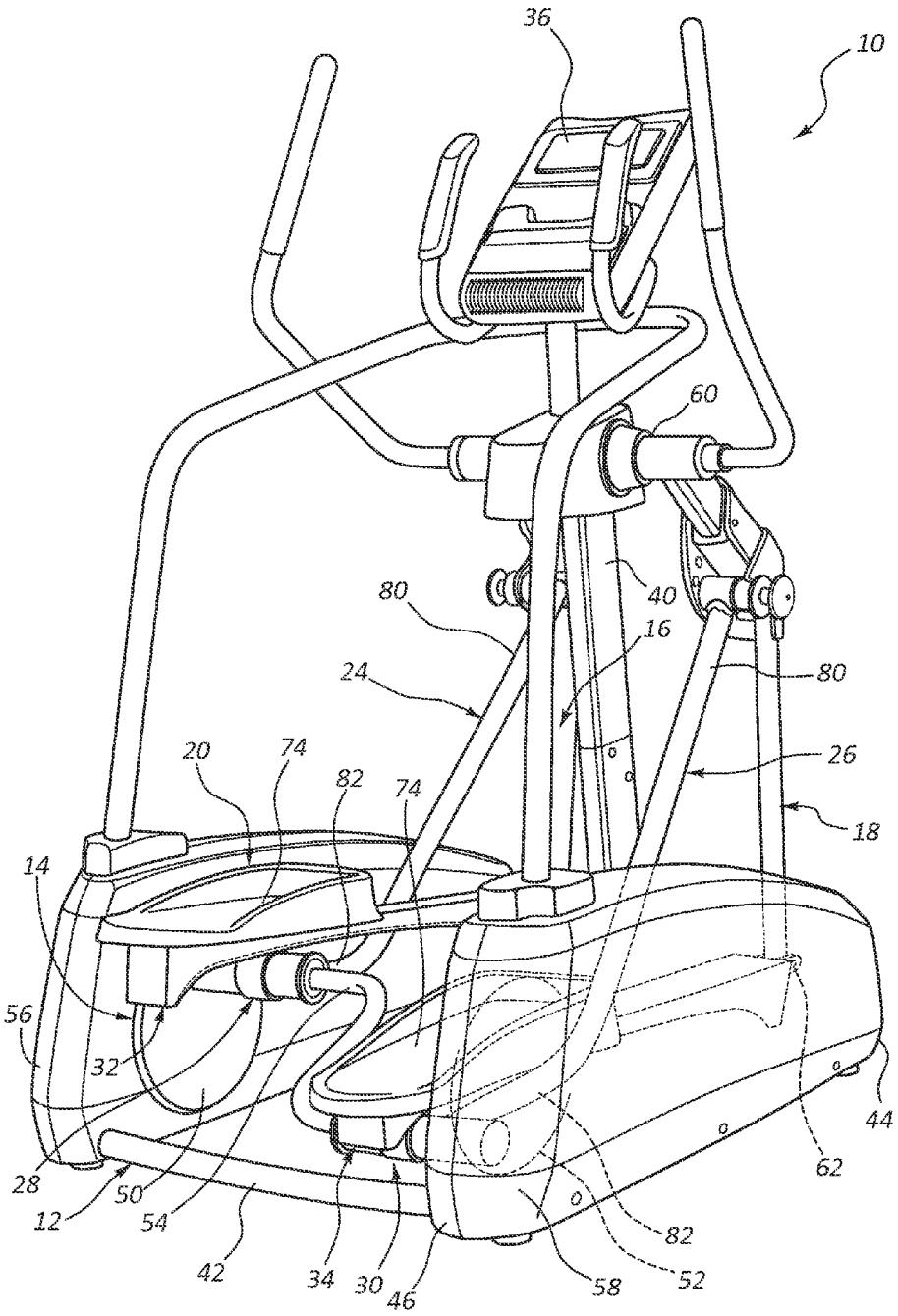
FIG. 1 illustrates a rear perspective view of a rear mechanical-type elliptical exercise machine according to one embodiment.

Particularly, with reference to the figures, FIG. 1 shows a rear perspective view of the rear elliptical exercise machine 10 according to the present systems and methods. The elliptical exercise machine 10 includes a frame 12, a drive assembly 14, first and second swing arms 16, 18, first and second foot supports 20, 22, first and second linked arms 24, 26, first and second rollers 28, 30, and first and second guide rails 32, 34. The frame 12 includes an upright support structure 40, a base support structure 42, and front and rear ends 44, 46.

The drive assembly 14 includes first and second drive members 50, 52 and a crank arm 54 extending between the first and second drive members 50, 52. The first and second drive members may be positioned in opposing housings 56, 58. Alternatively, a single drive member positioned in only one of the housings 56, 58 may be used to rotate crank arm 54.

The crank arm 54 may carry the first and second rollers 28, 30. The first and second link arms 24, 26 are also connected to the crank arm 54. The crank arm 54 may be operated by at least one of operating the drive member 50 moving the first and second link arms 24, 26.

The first and second swing arms 16, 18 include a first pivot point 60 and a second pivot point 62. The first pivot point 60 may be pivotally connected to the upright support structure 40. The second pivot point 62 provides a pivotal connection to the first and second guide rails 32, 34.

The first and second foot supports 20, 22 each include a foot pad 74 that supports a foot of the operator. The foot pads 74 are connected to each of the first and second guide rails 32, 34.

The first and second link arms 24, 26 include first and second ends 80, 82. The first end 80 is pivotally connected to the first and second swing arms 16, 18. The second end 82 is connected to the crank arm 54.

Figure 2A:
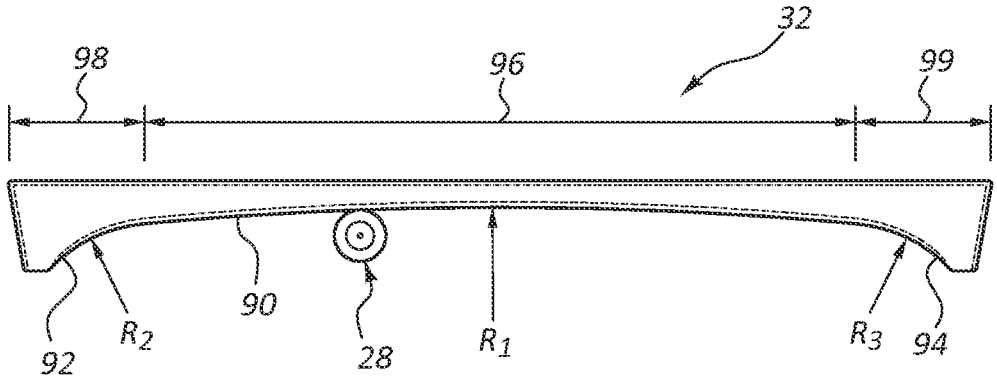
FIGS. 2A-2C illustrates side views of a guide rail of the elliptical exercise machine of FIG. 1 with a roller at different positions along the guide rail.
Figure 2B:
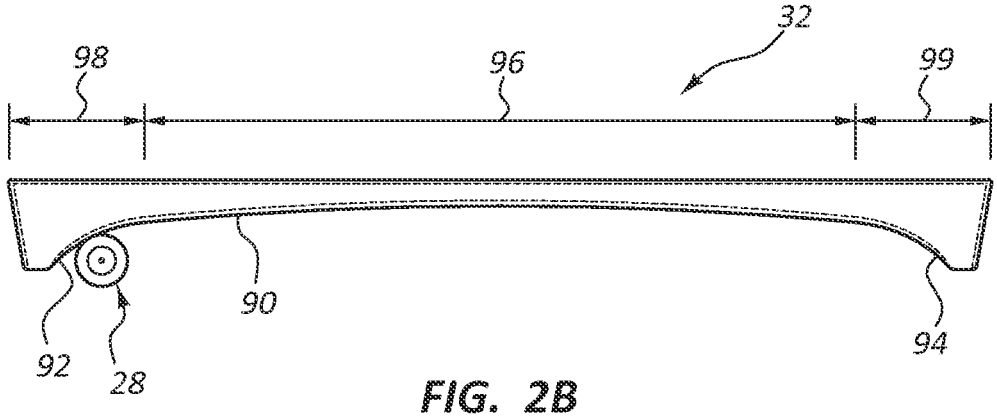
Figure 2C:
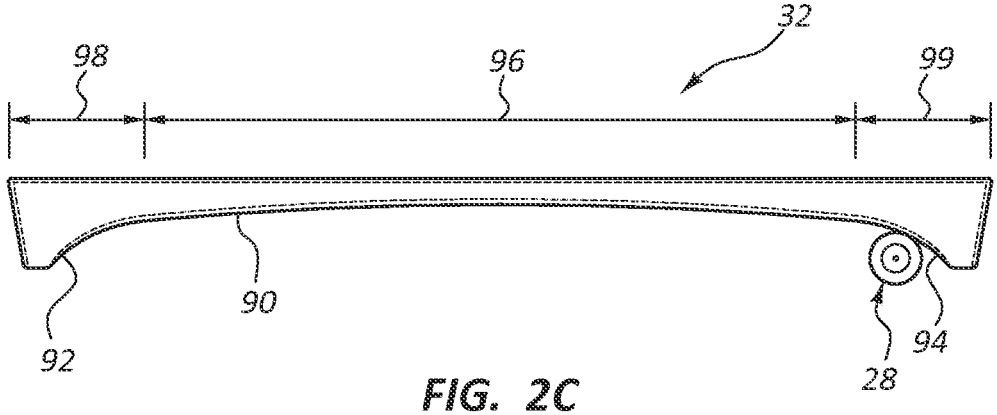

The first and second guide rails 32, 34 each include a track surface 90 as shown with reference to FIGS. 2A-2C. The track surface 90 includes first and second ends 92, 94. The first and second guide rails 32, 34 include a mid-section 96 and first and second end sections 98, 99.

As shown in FIG. 2A, the track surface 90 has a first radius $R_1$ along the mid-section 96. The track surface 90 has second and third radiuses $R_2$, $R_3$ along the first and second end sections 98, 99, respectively. The first radius $R_1$ is greater than the second and third radiuses $R_2$, $R_3$. In one example, the radius $R_1$ is greater than 1 meter. The radius $R_1$ may be in the range of about 10 to about 100 times greater than the second and third radiuses $R_2$ $R_3$. The radius $R_1$ may be infinitely large so as to approach a linear shape rather than a curve.

The radius $R_2$ $R_3$ may be in the range of about 1 to about 8 centimeters. The second and third radiuses $R_2$, $R_3$ may be substantially the same. In at least one example, the first and second end sections 98, 99 are substantial mirror images of each other. Many other configurations are possible wherein the first and second end sections 98, 99 have different configurations such as, for example, having second and third radiuses $R_2$, $R_3$ that are different from each other. According to one embodiment, the radius $R_2$ $R_3$ may be progressively decreasing to provide increasing, yet not abrupt resistance to the user as they near the end of the guide rail.

Figure 5:
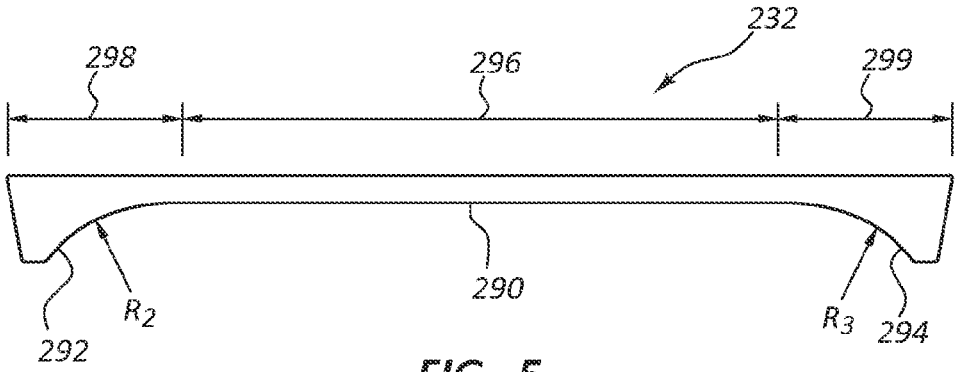
FIGS. 5-8 illustrate side views of alternative guide rails for use with the elliptical exercise machines disclosed herein.

FIGS. 5-8 show alternative guide rail designs having different track surface configurations. FIG. 5 shows a guide rail 232 having a track surface 290 with opposing ends 292, 294, a mid-section 296, and first and second end sections 298, 299. The track surface 90 along the mid-section 296 is substantially linear, having a very large radius. The radiuses $R_2$, $R_3$ at the end sections 298, 299 are substantially the same. Other arrangements are possible wherein the mid-section 296 includes a substantially linear portion and the radiuses $R_2$, $R_3$ of the end section 298, 299 are different.

Figure 6:
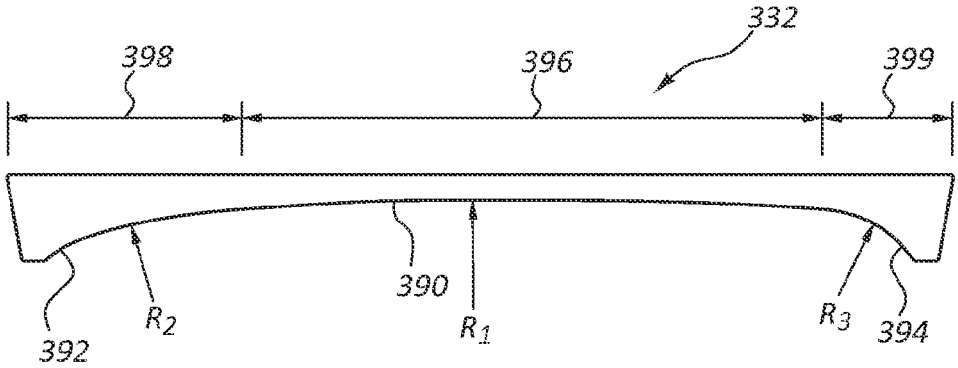

FIG. 6 shows a guide rail 332 having a track surface 390 with opposing ends 392, 394, a mid-section 396, and first and end sections 398, 399. The track surface 390 has a radius $R_1$ along the mid-section 396, a radius $R_2$ along end section 398, and a radius $R_3$ along end section 399. The radiuses $R_2$, $R_3$ are different. Each of the radiuses $R_2$, $R_3$ are less than the radius $R_1$. Other arrangements are possible in which the mid-section 396 is substantially linear instead of having a radius $R_1$.

Figure 7:
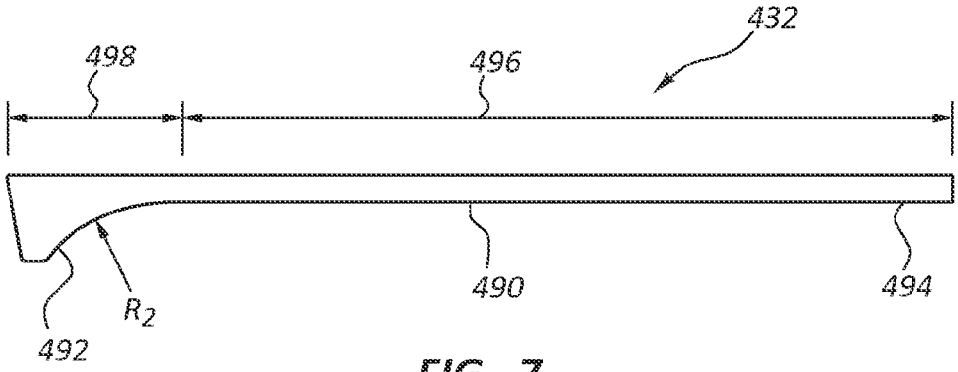

FIG. 7 shows a guide rail 432 having a track surface 490 with opposing ends 492, 494, a mid-section 496, and an end section 498. The track surface 490 along the mid-section 496 is substantially linear. The end section 498 has a radius $R_2$. The guide rail 432 has an arch portion at only one of the end sections. The end 494 is included in the mid-section 496.

Figure 8:
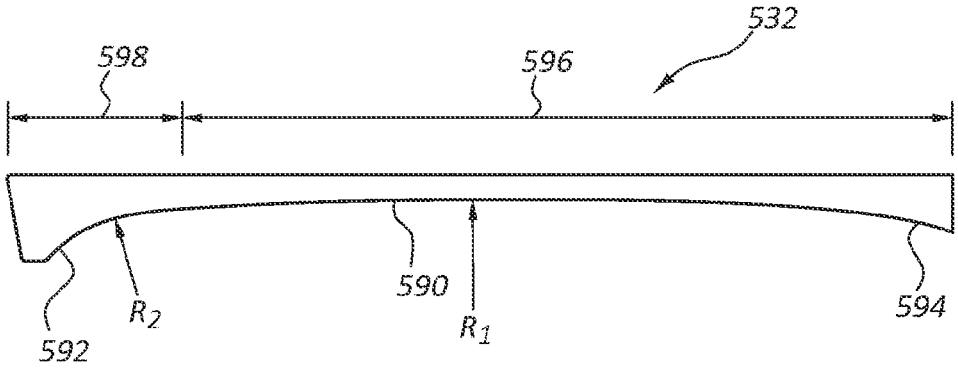

FIG. 8 shows a guide rail 532 having a track surface 590 with opposing ends 592, 594, a mid-section 596, and an end section 598. The mid-section 596 has a radius $R_1$ that is continuous from the end 594 and along the mid-section 596. The end section 598 has a different radius $R_2$ than the radius $R_1$ of the mid-section 596. The radius $R_2$ is less than the radius $R_1$.

The example track surfaces for guide rail of the elliptical exercise machines disclosed herein may generally be referred to as a variable radius track surface. Alternatively, the track surface may be referred to as an arch-shaped track surface or arch-shaped guide rail. The guide rail or track surface may include an arch-shape portion and may include curvature along only portions of a length of the track surface.

Referring again to FIGS. 2A, 2C, the roller 28 may move along the track surface 90 of the first guide rail 32. The guide rail 32 and roller 28 may be combined to form a roller assembly, a track assembly or an interface assembly that is operable between the drive assembly and the foot supports. FIG. 2A shows the roller 28 contacting the track surface 90 along the mid-section 96. As the roller 28 moves towards the first end 92 as shown in FIG. 2B, the amount of force required to move the roller 28 further towards the first end 92 increases. In some arrangements, the amount of force required for further relative movement between the roller 28 and track surface 90 toward first end 92 increases substantially such that the roller 28 either stops short of the first end 92 or there is little to no impact force when the roller 28 reached first end 92.

FIG. 2C shows the roller 28 positioned at an opposite end of the guide rail 32 near the second end 94 of the track surface 90. The amount of force required to move the roller 28 along the track surface 90 towards the second end 94 may increase as compared to when the roller 28 is moving along the mid-section 96. The amount of force required to move the roller 28 further toward second end 94 may increase sufficient that the roller 28 slows down to either stop short of second end 94 or create little to no impact force when the roller 28 reached second end 94.

The change in radius of the track surface 90 from $R_1$ to $R_2$ or from $R_1$ to $R_3$, wherein the radiuses $R_2$, $R_3$ are smaller than the radius $R_1$, may create an increased resistance to movement of the roller as it moves towards the first and second ends 92, 94. This resistance to movement may slow down relative movement between the guide rail 32 and the roller 28 so that the operator or drive assembly must exert additional force to continue the relative movement.

The rear drive elliptical exercise machine of FIG. 1 includes first and second guide rails 32, 34 that are oriented with the track surface 90 facing in a downward direction. The rollers are fixed to the frame and the first and second guide rails 32, 34 are carried by the foot supports, or at least operatively linked to the foot supports. Other embodiments are possible with a rear drive elliptical exercise machine in which the rollers are carried by the foot supports, or at least operatively linked to the foot supports, and the guide rails are fixed relative to the frame. In such an arrangement, the guide rails may be oriented facing upward.

Figure 3:
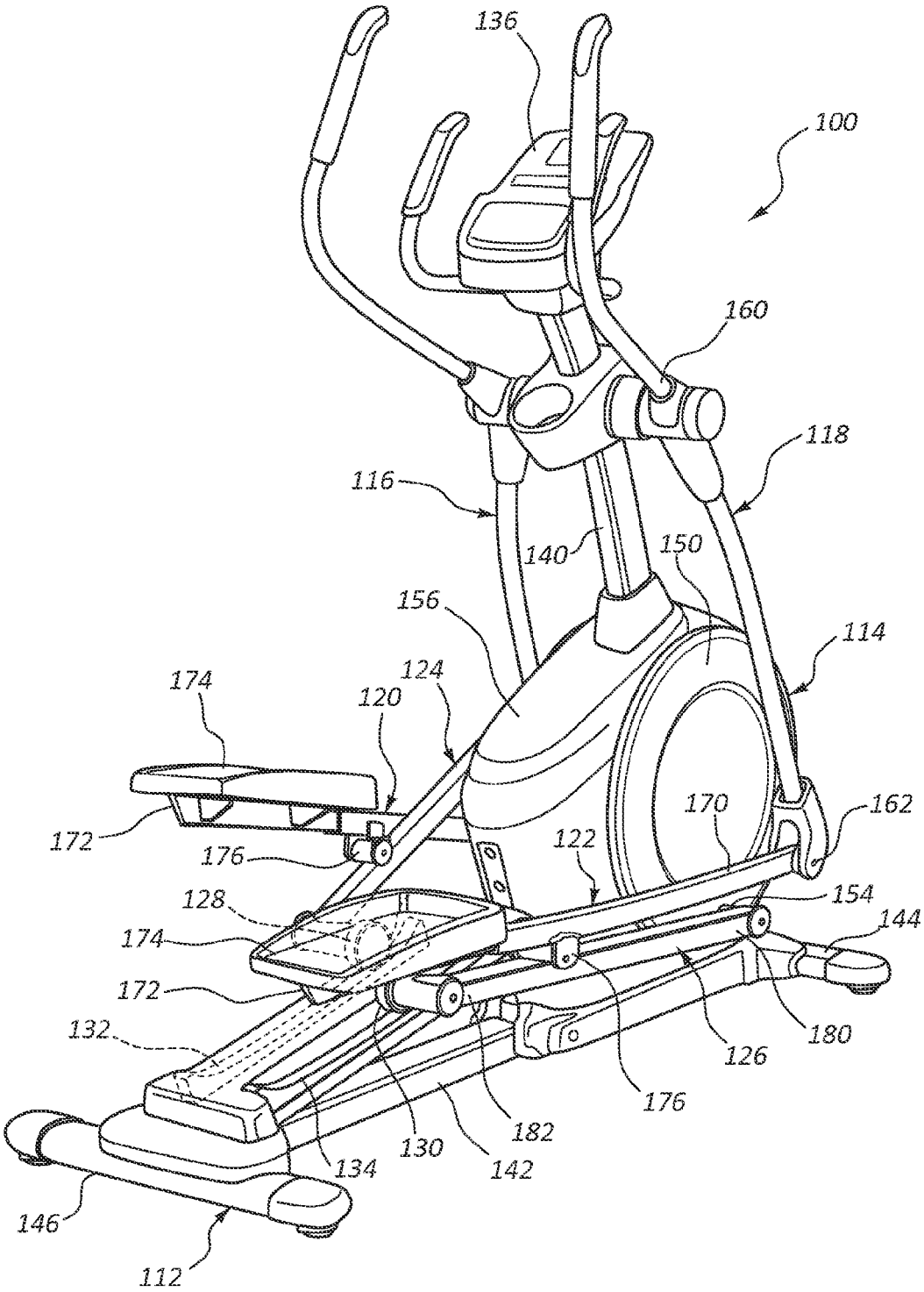
FIG. 3 illustrates a rear perspective view of a front mechanical-type the elliptical exercise machine according to one embodiment.

Referring now to FIG. 3, another example elliptical exercise machine 100 is shown according to the present systems and methods. The elliptical exercise machine 100 includes a frame 112, a drive assembly 114, first and second swing arms 116, 118, first and second foot supports 120, 122, first and second link arms 124, 126, first and second rollers 128, 130, and first and second guide rails 132, 134. The frame 112 includes an upright support structure 140, a base support structure 142, and front and rear ends 144, 146.

The drive assembly 114 is positioned at the front end 144. The drive assembly 114 includes a drive member 150, at least one crank arm 154, and a housing 156. The drive assembly 114 may include another crank arm (not shown) extending from an opposing side of the drive assembly 114.

The first and second swing arms 116, 118 include first and second pivot points 160, 162. The first pivot point 160 provides a pivotal connection to the upright support structure 140. The second pivot point 162 provides a pivotal connection with the first and second link arms 124, 126.

The first and second foot supports 120, 122 include first and second ends 170, 172, a link connector 176, and a foot pad 174. The link connector 176 provides a pivotal connection between the first and second foot supports 120, 122 and the first and second link arms 124, 126. The first and second link arms 124, 126 each include first and second ends 180, 182. The first end 180 is pivotally connected to the crank arm 54. The second end 182 supports the first and second rollers 128, 130.

The first and second guide rails 132, 134 are mounted to the base support structure 142 at the rear end 146. In at least one arrangement, the first and second guide rails 132, 134 are connected or assembled together. In one example, the first and second guide rails 132, 134 are formed as a single piece. The first and second guide rails 132, 134 may be adjustable to change an incline or angled orientation relative to the frame 112.

Figure 4A:
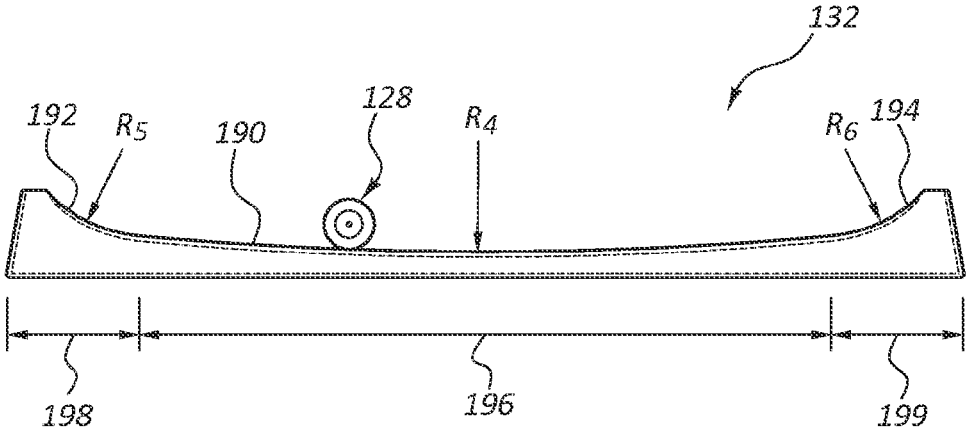
FIGS. 4A-4C illustrate side views of a guide rail of the elliptical exercise machine of FIG. 3 with a roller at different positions along the guide rail.
Figure 4B:
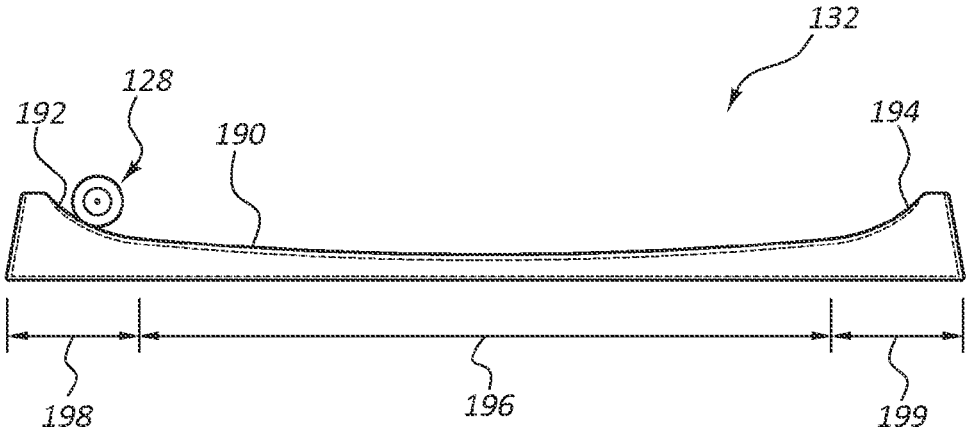
Figure 4C:
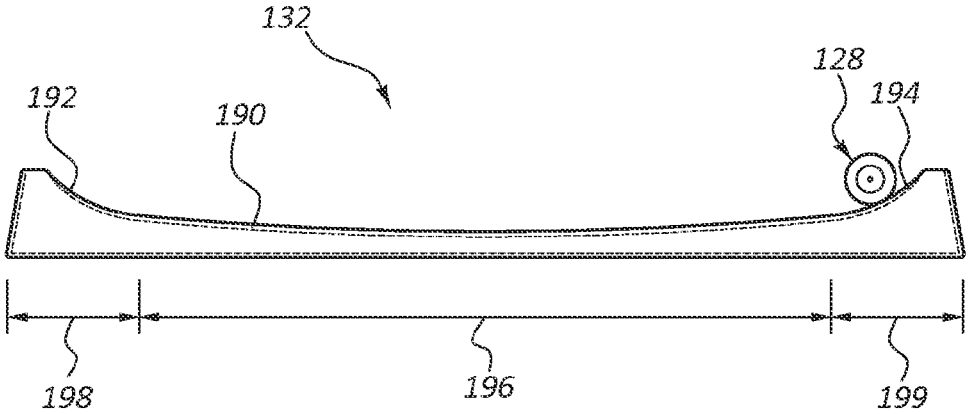

The first and second guide rails 132, 134 include a track surface 190 as shown in FIGS. 4A-4C. The track surface 190 includes first and second ends 192, 194. The first and second guide rails 132, 134 also include a mid-section 196 and first and second end sections 198, 199. The track surface 190 along the mid-section 196 may have a first radius $R_4$. The track surface 190 along the first and second end sections 198, 199 have second and third radius $R_5$, $R_6$, respectively.

The second and third radiuses $R_5$, $R_6$ are shown in FIG. 3 being substantially the same. The second and third radiuses $R_5$, $R_6$ are less than the first radius $R_4$. Other configurations are possible for the track surface 190 including any of the variations described above with reference to FIGS. 2A-2C and 5-8.

The first and second guide rails 132, 134 may be arranged at different angled orientations as shown in FIG. 3 (e.g., orientations from substantially horizontal to an angle of about 45 degrees). The second and third radiuses $R_5$, $R_6$ may be optimized for different angled position of the guide rails. In alternative embodiments, it may be possible to replace at least one of the first and second guide rails 132, 134 with a guide rail having a different track surface configuration that is optimum for a given angle of orientation (e.g., a track surface having second and third radiuses $R_5$, $R_6$ that are different from each other). In other embodiments, it may be possible to adjust or alter the track surfaces 190 (e.g., the first, second, third radiuses $R_4$, $R_5$, $R_6$) to provide varying amounts of resistance to movement of the first and second rollers 128, 130 along the first and second guide rails 132, 134 to alter performance of the elliptical exercise machine 100.

The front drive elliptical exercise machine of FIG. 3 includes first and second guide rails 132, 134 that are oriented with the track surface 190 facing in an upward direction. The first and second guide rails 132, 134 are fixed to the frame and the rollers are carried by the foot supports, or at least operatively linked to the foot supports. Other embodiments are possible with a front drive elliptical exercise machine in which the guide rails are carried by the foot supports, or at least operatively linked to the foot supports, and the rollers are fixed relative to the frame. In such an arrangement, the guide rails may be oriented in an opposite arrangement in which the track surface is facing downward.

INDUSTRIAL APPLICABILITY

In order to limit the chance of the rollers of the elliptical exercise machine hitting a hard stop during elliptical reciprocal movement of the foot supports, an elliptical machine having a guide rail with an arch shape track surface is provided. The arch shape track surface may have a variable radius of curvature along its length to limit the chance of the roller hitting a hard stop at one of the opposing ends of the track surface.

In general, the structure of the present disclosure provides an elliptical exercise machine that makes it less likely that the roller will hit a hard stop along its path of travel by pre-forming the track surface with at least one arc shaped or curved portion. The arch shaped portion creates resistance to relative movement between the roller and the guide rails as the roller approaches opposing ends of the track surface of the guide rail. The track surface may include a radius of curvature near opposing ends of the track surface that is smaller than a radius of curvature along a mid-section of the track surface, thereby making it more difficult for the roller to move along those end portions of the track.

A guide rail having a track surface with an arch shaped portion that provides these benefits may be fixed relative to the frame of the elliptical exercise machine, and the roller is movable with the foot support. In other arrangements, the guide rail is carried by the foot support and the roller is fixed relative to the frame. These arrangements may correspond to front and rear drive elliptical exercise machines, respectively. The present systems and methods may provide for reduced relative movement between the roller and the guide rail as the roller approaches an end of the track surface of the guide rail. This reduced relative movement may lessen the impact that otherwise occurs as the roller reaches the end of the track surface. In some arrangements, the reduced relative movement may result in complete stoppage of the roller relative to the guide rail before the roller reaches the end of the track surface thereby eliminating impact forces that may otherwise occur. The resulting performance of the elliptical exercise machine when using guide rails having a track surface with an arch shape or at least one arch shaped portion may include a smoother operation that avoids jarring forces during reciprocal elliptical movement of the foot supports during use.

In conclusion, the present system and method provides for an elliptical exercise machine with guide rails having at least one arch shaped portion. More specifically, the guide rails include arch shaped portions at opposing ends of the guide rail that slow relative movement between the guide rails and rollers that move along the guide rails during operation of the elliptical machine. The guide rails are configured to limit or eliminate impact forces typically created when the roller reaches the end of the track surface on the guide rail, thereby providing improved comfort for the operator and reduced machine wear when using the elliptical machine.

What is claimed is:

1. An elliptical exercise machine comprising:

a base support structure adapted to be positioned on a support surface;

first and second reciprocating foot supports, each foot support having an end movably linked to the base support structure;

first and second guide rails for guiding respective first and second foot supports to provide reciprocal movement of the foot supports;

the first and second guide rails each comprising an underside;

the underside defining a track surface having first and second end portions and at least first and second arch portions, the first arch portion being positioned at a location between the first and second end portions and having a first radius of curvature, and the second arch portion being positioned at one of the first and second end portions and having a second radius of curvature that is less than the first radius of curvature;

a drive assembly with a first drive member and a second drive member;

a crank arm extending from the first drive member and the second drive member; and first and second rollers connected to the crank arm and movable along the track surface of the underside of the first and second guide rails, respectively;

wherein the track surface includes a third arch portion positioned at an end portion of the track surface opposite the second arch portion, the third arch portion having a third radius of curvature that is less than the first radius of curvature;

wherein the second radius and the third radius are the same; and wherein the second radius and the third radius each span 14.0 percent to 25.0 percent of the track surface.

2. The elliptical exercise machine of claim 1, wherein the first radius of curvature is over 1 meter.

3. The elliptical exercise machine of claim 1, wherein the second radius of curvature is in the range of about 1 to 80 centimeters.

4. The elliptical exercise machine of claim 1, wherein the second radius of curvature is progressively decreasing in magnitude.

5. The elliptical exercise machine of claim 1, wherein the first and second guide rails are fixed relative to the foot supports.

6. The elliptical exercise machine of claim 1, further comprising an upright support structure extending upward from a front portion of the base support structure.

7. The elliptical exercise machine of claim 2, wherein the second and third radiuses of curvature is at least 10 times smaller than the first radius of curvature.

8. An elliptical exercise machine comprising:

a base support structure adapted to be positioned on a support surface;

first and second reciprocating foot supports, each foot support having a first end and a second end, the first end of each foot support being movably linked to the base support structure;

first and second guide rails for guiding second ends of respective first and second reciprocating foot supports to provide reciprocal movement of the foot supports, the first and second guide rails each comprising an underside with a track surface, the track surface having a variable radius of curvature along its length;

a drive assembly with a first drive member and a second drive member;

a crank arm extending from the first drive member and the second drive member;

first and second rollers connected to the crank arm and movable along the track surface of the underside of the first and second guide rails, respectively;

the at least one end includes opposing first and second end portions and a mid-section between the first and second end portions, wherein at least one of the first and second end portions has a smaller radius of curvature than the mid-section;

wherein the radius of curvature of the first and second end portions is the same; and wherein the second radius and the third radius each span 14.0 percent to 25.0 percent of the track surface.

9. The elliptical exercise machine of claim 8, further comprising first and second rollers positioned providing a low friction interface with the first and second guide rails, respectively.

10. The elliptical exercise machine of claim 8, wherein the track surface has an elongate shape with a midpoint and opposing ends, and a decreasing radius of curvature from the midpoint to toward the opposing ends.

11. The elliptical exercise machine of claim 8, wherein the track surface has a continuous arch construction in the mid-section.

12. An elliptical exercise machine comprising:

a base support structure adapted to be positioned on a support surface;

an upright support structure extending upward from a front portion of the base support structure;

first and second reciprocating foot supports movably linked to the base support structure;

a drive assembly supported by the base support structure, the foot supports being linked to the drive assembly;

wherein the drive assembly includes a first drive member and a second drive member;

a crank arm extending from the first drive member and the second drive member;

first and second swing arms, each arm having an upper portion and a lower portion, the upper portion of each arm being pivotally connected to the upright support structure, the lower portion of each arm being interconnected to the crank arm;

a roller assembly interposed between the drive assembly and the foot supports, the roller assembly comprising:

a first guide rail and a second guide rail, wherein each of the first guide rail and the second guide rail have an underside that forms an arch shaped track surface;

a first roller and a second roller connected to the crank arm and configured to move along the arch shaped track surfaces of the first guide rail and the second guide rail, respectively, to provide reciprocal movement of the foot supports;

wherein the track surface includes opposing first and second end portions and a mid-section between the first and second end portions, wherein at least both of the first and second end portions has a smaller radius of curvature than the mid-section; and wherein the radius of curvature of the first and second end portions is the same and is at least 10 times smaller than the curvature of the mid-section.

13. The elliptical exercise machine of claim 12, wherein the arch shaped track surfaces comprises a radius of curvature that decreases toward each of the first and second end portions.

14. The elliptical exercise machine of claim 12, wherein the first roller and the second roller maintain a fixed position relative to the base support structure; and wherein the first and second guide rails move with the foot supports.

15. The elliptical exercise machine of claim 1, further comprising a swing arm connected to the crank arm.

16. The elliptical exercise machine of claim 1, further comprising a linked arm connected to the crank arm.

17. The elliptical exercise machine of claim 1, further comprising a swing arm and a linked arm connected to the crank arm.

* * * * *